US007299004B2

(12) United States Patent
Kawachi et al.

(10) Patent No.: US 7,299,004 B2
(45) Date of Patent: Nov. 20, 2007

(54) IMAGE FORMING APPARATUS

(75) Inventors: Kunihiro Kawachi, Tokyo (JP); Kazunobu Miura, Hachioji (JP); Ken Nonaka, Hachioji (JP); Kyoichi Mizuno, Tama (JP); Shinichi Kawabata, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 209 days.

(21) Appl. No.: 10/948,565

(22) Filed: Sep. 24, 2004

(65) Prior Publication Data

US 2005/0201795 A1 Sep. 15, 2005

(30) Foreign Application Priority Data

Mar. 10, 2004 (JP) ..... 2004-066628

(51) Int. Cl.
*G03G 15/00* (2006.01)

(52) U.S. Cl. ..... 399/406; 271/188

(58) Field of Classification Search ..... 399/397, 399/405, 406, 407; 271/188
See application file for complete search history.

(56) References Cited

U.S. PATENT DOCUMENTS

| | | | | |
|---|---|---|---|---|
| 5,191,379 | A * | 3/1993 | Manzer et al. | 399/406 |
| 5,396,318 | A * | 3/1995 | Asada | 399/328 |
| 5,557,388 | A * | 9/1996 | Creutzmann et al. | 399/92 |
| 5,680,651 | A * | 10/1997 | Tsuji et al. | 399/401 |
| 5,920,759 | A * | 7/1999 | Ushiroji et al. | 399/406 |
| 5,953,575 | A * | 9/1999 | Park et al. | 399/401 |
| 6,094,560 | A * | 7/2000 | Thomas | 399/341 |
| 6,259,887 | B1 * | 7/2001 | Awano | 399/390 |
| 6,775,516 | B2 * | 8/2004 | Kouno | 399/406 |
| 6,934,507 | B2 * | 8/2005 | Ohki et al. | 399/406 |
| 2004/0067082 | A1 * | 4/2004 | Uehara et al. | 399/341 |

FOREIGN PATENT DOCUMENTS

| | | | |
|---|---|---|---|
| JP | 04056980 | A * | 2/1992 |
| JP | 6-3900 | | 1/1994 |
| JP | 07017655 | A * | 1/1995 |
| JP | 2003073006 | A * | 3/2003 |

OTHER PUBLICATIONS

Patent Abstracts of Japan Publication No. 06-003900 dated Jan. 14, 1994.

* cited by examiner

*Primary Examiner*—Ren Yan
(74) *Attorney, Agent, or Firm*—Finnegan, Henderson, Farabow, Garrett & Dunner, L.L.P.

(57) ABSTRACT

An image forming apparatus, including:

an image forming section for forming a toner image on a transfer sheet;

a fixing section for fixing the toner image on the transfer sheet;

a sheet ejection section for ejecting the sheet on which the toner image has been fixed; and a sheet guide section, including a first guide member and a second guide member both of which are paired for guiding the sheet from the fixing section to the sheet ejection section;

wherein a heat radiation characteristic of the first guide member is greater than that of the second guide member.

7 Claims, 3 Drawing Sheets

IMAGE FORMING APPARATUS

BACKGROUND OF THE INVENTION

The present invention relates to an image forming apparatus in which curling of a transfer sheet, happened immediately after fixing, is reduced.

An image forming apparatus is composed of an image carrier for carrying a toner image, an image writing section for writing an electrostatic latent image onto the image carrier, a developing section for developing the electrostatic latent image, a transfer section for transferring the toner image onto a transfer sheet, and a fixing device for fixing the toner image transferred onto the transfer sheet.

The fixing device incorporates a heating roller including a heating means such as a halogen lamp, and a pressure roller for pressuring the transfer sheet to the heating roller. When the transfer sheet travels through a nipping point formed by a contact area between the heating roller and the pressure roller, the toner is melted so that the toner is fixed onto the transfer sheet. When the transfer sheet has passed the nipping point of the heating roller and the pressure roller, the transfer sheet is curled due to the temperature difference on the surface in contact with the heating roller and the other surface in contact with the pressure roller. The curling of the transfer sheet tends to result in sheet jamming sheet during conveyance, and irregular alignment of the transfer sheets, when ejected. Therefore, the curl requires straightening after fixing.

In order to straighten the curled sheets, a special correcting device is used. Concerning the curl correcting device, one example incorporates paired rollers, being a hard roller and a soft roller, and the curled sheet is conveyed through the nipped section of the paired rollers, and thereby the curled sheet is straightened by a mechanical method. Another example incorporates a pressure roller having a hard surface, and a correcting roller having a soft surface which includes a heating means, whereby the curl resulting from the fixing device is forced to be an opposite direction (see Patent Document 1).

Patent Document 1: Official Gazette of Japanese Tokkaihei 6-3900

However, regarding the curl correcting device using the rollers described above, the paired rollers and a driving motor for rotating the paired rollers are necessary. Therefore, the mechanical structure of the curl correcting device requires a complicated mechanism, resulting in a rise in the cost. Further, there are also problem that a space for installing the correcting device is rarely prepared in the layout of the device, and thus to include the correcting device, the overall image forming apparatus size is increased.

SUMMARY OF THE INVENTION

The objective of the present invention is to provide an image forming apparatus wherein the curling of transfer sheets is reduced without using special paired rollers. The objective of the invention will be attained by any one of the structures described below.

Structure 1

An image forming apparatus, including:

an image carrier for carrying a toner image, an image writing section for forming an electrostatic latent image onto the image carrier, a developing section for developing the electrostatic latent image, and forming the toner image, a transfer section for transferring the toner image onto a transfer sheet, a fixing device for fixing the toner image transferred onto the transfer sheet, and paired guide members, being a first guide member and a second guide member, for guiding the transfer sheet carrying the toner image fixed by the fixing device, to a sheet ejection section, wherein a heat radiation characteristic of one of the guide members, being a first guide member, is greater than that of the other guide member, being a second guide member.

Structure 2

The image forming apparatus described in Structure 1, wherein each of the paired guide members is made of different materials respectively.

Structure 3

The image forming apparatus described in Structure 1, wherein one of the paired guide members is made of an aluminum plate.

Structure 4

The image forming apparatus described in structure 1, wherein the other paired guide member is made of a resin material.

Structure 5

The image forming apparatus described in Structure 1, further incorporates a cooling means for cooling one of the paired guide members.

Structure 6

The image forming apparatus described in Structure 1, wherein the fixing device incorporates:

a heating member including a heater, and a pressure applying member, both of which nip the transfer sheet, and wherein one of the guide members faces a surface of the transfer sheet which has been contact with the heating member, and the other guide member faces a surface of the transfer sheet which has been contact with the pressure applying member.

Structure 7

The image forming apparatus described in Structure 1, wherein one of the guide members incorporates a plurality of ribs for radiating heat.

EFFECTS OF THE INVENTION

The image forming apparatus described in Structure 1 incorporates the image carrier, image writing section, developing section, transfer section, fixing device, and paired guide members. Since the heat radiation characteristic of one of the guide members is greater than that of the other guide member, when the fixed transfer sheet is guided by the paired guide members, the surface temperature of the sheet is lowered, being in contact with the guide member having higher heat radiation characteristics. Due to this, the temperature difference of both surfaces is reduced so that the curl of the transfer sheet is prevented, without requiring additional mechanical parts.

In the image forming apparatus described in Structure 2, the paired guide members are made of materials having different heat radiation characteristics. Due to this, the temperature difference between the front surface and the rear surface of the sheet is reduced.

In the image forming apparatus in Structure 3, describing the paired guide rollers, one of the paired guide members, having the higher heat radiation characteristic, is formed of an aluminum plate. Due to this, the temperature of the sheet surface having the higher temperature is quickly lowered, resulting in a small temperature difference between the front surface and the rear surface of the transfer sheet.

In the image forming apparatus described in Structure 4, regarding the paired guide members, the other guide member having the lower heat radiation characteristic is formed of a resin. Due to this, the temperature of lower temperature surface is lowered very slowly, resulting in a small temperature difference between the front surface and the rear surfaces of the transfer sheet.

The image forming apparatus described in Structure 5 incorporates a means for cooling one of the guide members having the higher heat radiation characteristic. Due to this, the temperature of one of the guide members is quickly lowered, resulting in effective cooling of one of the surfaces of the transfer sheet.

In the image forming apparatus described in Structure 6, the guide member featuring the higher heat radiation characteristic is disposed on the heating member side of the fixing device, which can reduce the temperature of the surface of the transfer sheet heated by the heating member, and thereby, any curl caused by the temperature difference between the front surface and the rear surface of the transfer sheet, can be effectively prevented.

In the image forming apparatus described in Structure 7, one of the guide members has a plurality of ribs, which increases heat radiation.

DETAILED DESCRIPTION OF THE PREFERRED EMBODIMENT

Figure 1:
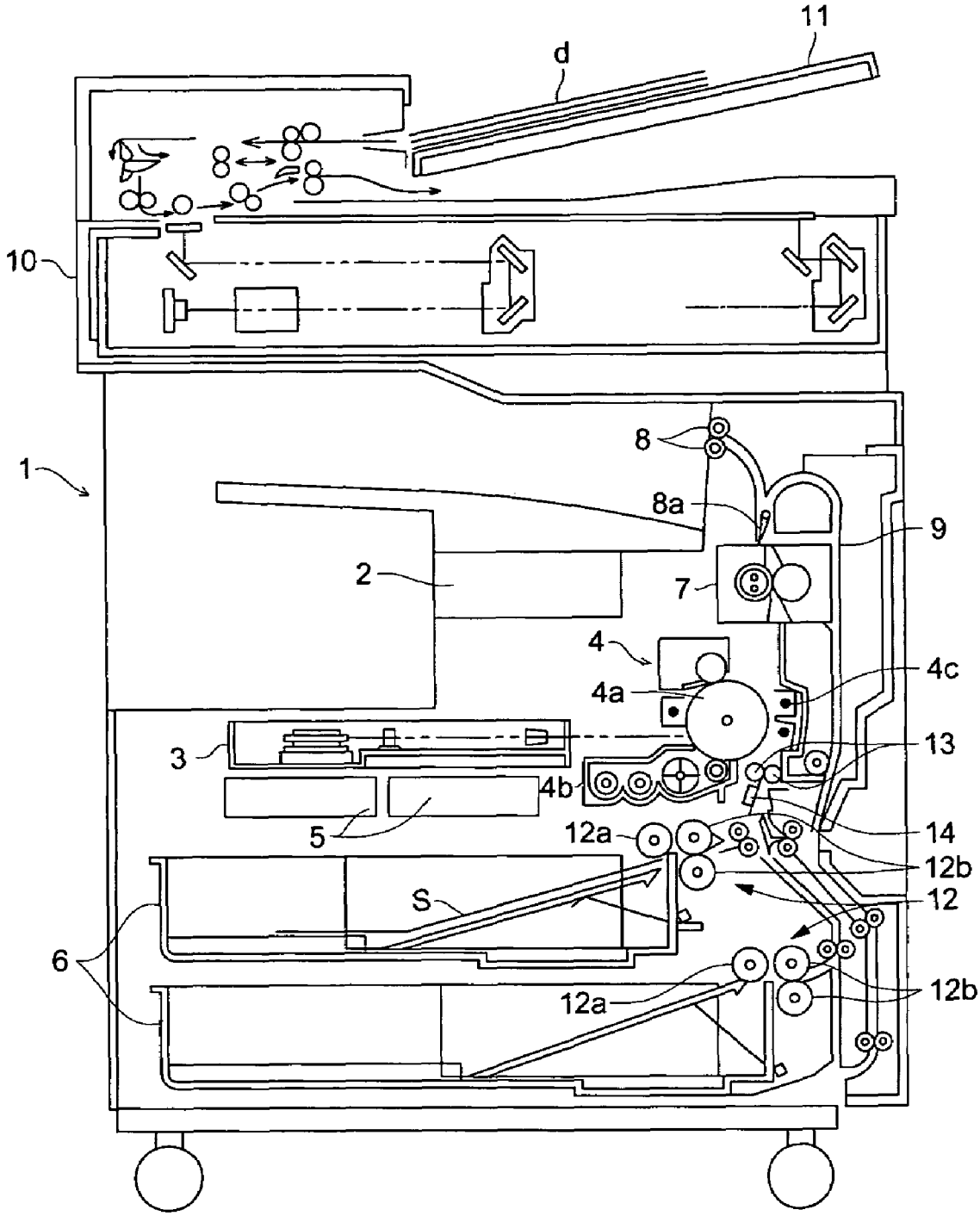
FIG. 1 shows the overall structure of an image forming apparatus of the present invention.

The image forming apparatus of the present invention will be now explained, referring to the drawings. FIG. 1 shows the overall structure of the image forming apparatus of the present invention. Image forming apparatus 1 incorporates image processing section 2, image writing section 3, image forming section 4, high tension power supply section 5, sheet supplying cassette 6, fixing device 7, sheet ejecting rollers 8, and re-conveyance means 9 for double side printing. Further, image reading device 10 and document feeding device 11 are installed on image forming apparatus 1.

Document d placed on document feeding device 11 is conveyed in the arrowed direction, and the images on a single surface or double side surfaces of document d are read out as analog signals by an optical system of document reading device 10. Analog processing, A/D conversion, shading correction, and image compression process are conducted on the read-out analog signals, in image processing section 2, then the signals, being the image data, are sent to image writing section 3.

Image writing section 3 forms the image data, sent from image processing section 2, to be the electrostatic latent image, onto image carrier 4*a*. This process is performed by radiating the output rays of a semiconductor laser provided in image writing section 3, onto image carrier 4*a* which is thereby uniformly electro-statically charged. The formed electrostatic latent image is developed at developing device 4*b* to become a toner image, and which is transferred by transfer device 4*c* onto transfer sheet S conveyed from sheet supplying cassette 6, then the toner image is fixed onto transfer sheet S by fixing device 7. In the double sided copying mode, sheet S is directed to re-conveyance means 9 by conveyance route changing plate 8*a*, where sheet S is flipped over, after which transfer sheet S is again conveyed to image forming section 4. When the image formation is completed, transfer sheet S is ejected onto a sheet receiving tray of image forming apparatus 1 by paired ejecting rollers 8.

The sheet supplying device is composed of sheet supplying cassette 6, and sheet supplying means 12 for picking up a single sheet S and sending it to image forming section 4. Sheet supplying means 12 incorporates pick-up roller 12*a*, and multi-feed preventing rollers 12*b*. The uppermost of sheets S stored in sheet supplying cassette 6 is taken out by pick-up roller 12*a*, then transfer sheet S is isolated by multi-feed preventing rollers 12*b*, and is conveyed to image forming section 4. Paired registration rollers 13 for straightening skewed sheet S, are located just below image forming section 4, and detecting means 14 for detecting passage of transfer sheet S is located below registration rollers 13.

Figure 2:
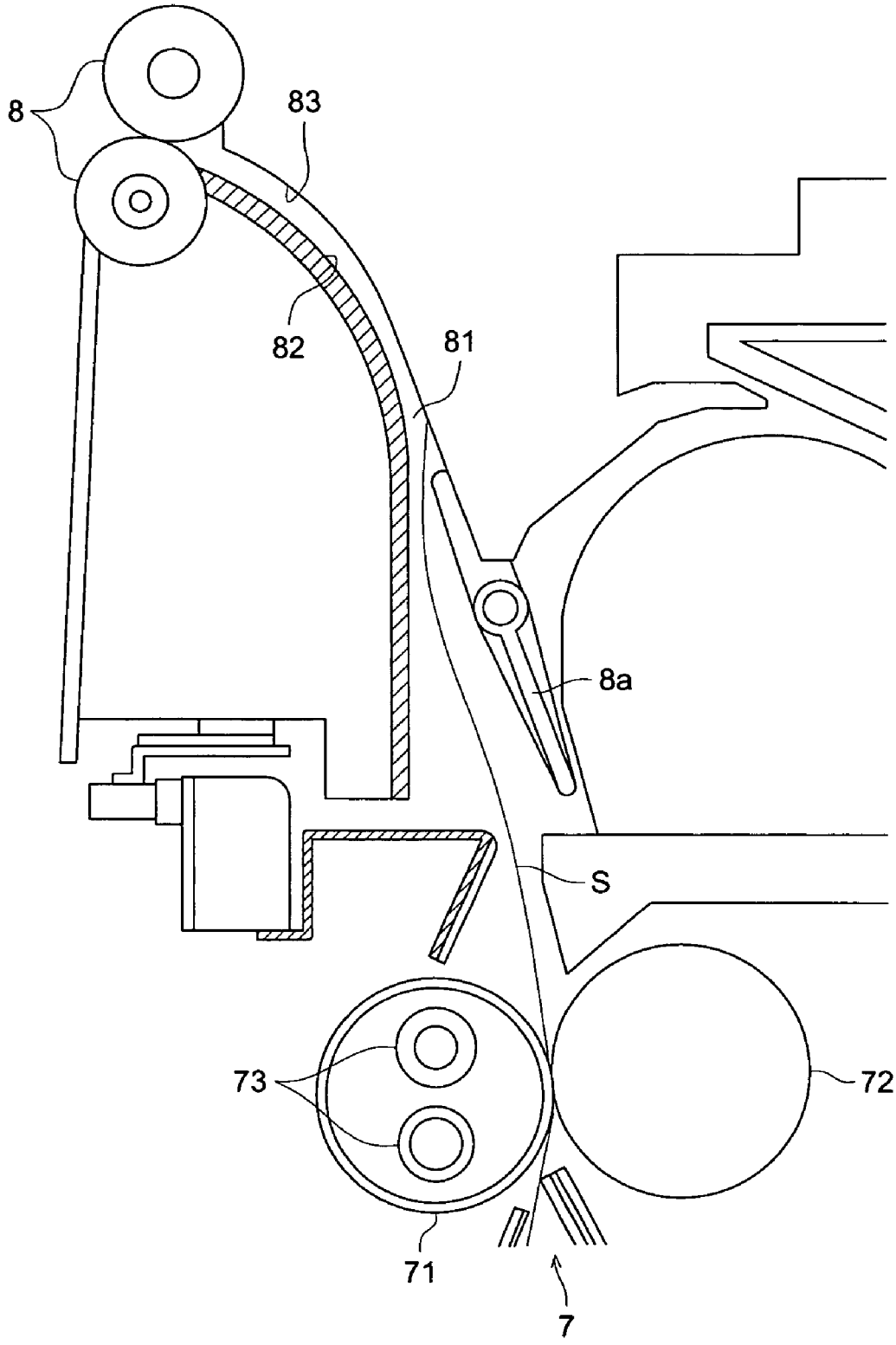
FIG. 2 shows the structure from the fixing device to the sheet ejecting rollers of the first embodiment of the present invention.

FIG. 2 shows the structure of the area between the fixing device and the sheet ejecting rollers. Fixing device 7 incorporates heating roller 71, used as a heating member, and pressure applying roller 72, used as a pressure applying member, and further heating means 73 such as a halogen lamp is included in heating roller 71. When sheet S is conveyed through the nipping point formed by heating roller 71 and pressure applying roller 72, the toner particles on transfer sheet S are melted so that the toner composed image is fixed onto transfer sheet S. In this case, the image surface of transfer sheet S, being in contact with heating roller 71, is heated and slightly distended, but the other surface of transfer sheet S, being in contact with pressure applying roller 72, is not heated nor distended. That is, when there is a temperature difference between the front surface and the back surface of transfer sheet S, distension occurs between both surfaces of transfer sheet S, resulting in curling wherein the surface of lower temperature is in-winded. In FIG. 2, heating roller 71 is located on the left, and thereby, sheet S is curled to the right, that is, curled toward pressure applying roller 72. The reason for the curl to occur on sheet S is, as described above, the difference of distension caused by the difference of temperature between the two surfaces. If the difference of temperature of both surfaces is reduced enough, the curl of sheet S is also reduced.

Transfer sheet S passing through fixing device 7 is conveyed toward sheet ejecting rollers 8 via conveyance route 81, and is ejected onto the sheet receiving section. Conveyance route 81 is formed by the guide plates 82 and 83 as a paired guide member, between which sheet S is conveyed. Regarding guide plates 82 and 83, guide plate 82 (which is a first guide member), being on the heating roller 71 side, facing the higher temperature surface side of transfer sheet S, is formed of, for example, an aluminum plate, which is a material having high heat radiation characteristics. On the other hand, guide plate 83 is formed of, for example, a resin, and has lower heat radiation characteristics. Generally, since aluminum has high heat conductivity and low heat capacity, it effectively absorbs the heat stored in transfer sheet S. On the other hand, as the other surface of transfer sheet S is in contact with guide plate 83, made of a resin having lower heat conductivity, therefore, a great temperature change does not occur on the other surface of sheet S. In this case, sheet S is conveyed, while being sandwiched between guide plates

82 and 83, each of which has different heat conductivities, and thereby, the temperature difference between the front surface and back surface of transfer sheet S is reduced so that the curling is prevented.

In the embodiment shown in FIG. 2, guide plate 82 is made of aluminum, and guide plate 83 is made of a resin, however, the present invention is not limited to this embodiment. In order to reduce the curl of transfer sheet S, it is necessary to reduce the temperature difference between the front surface and the back surface of transfer sheet S, therefore, for guide plate 82 which is a higher temperature side, a material should be used which has higher heat radiation characteristic than that of a material of guide plate 83, that is, a material having higher heat conductivity and lower heat capacity is preferably used.

For example, if the aluminum plates are used for both guide plates 82 and 83, and if the thickness of guide plate 82 is less than that of guide plate 83, the heat capacity of guide plate 82 is lower than that of guide plate 83, which can also reduce the curl of transfer sheet S. Further, guide plate 83 can be formed of a metal such as cupper having relatively high heat capacity. Still further, it is possible that guide plate 82 is formed of a cupper plate and guide plate 83 is formed of a resin plate. Additionally, it is possible that a plurality of ribs are formed on guide plate 82 parallel to the sheet conveyance direction, so that as the surface area of guide plate 82 is enlarged, the heat radiation characteristics of guide plate 82 is also increased.

Figure 3:
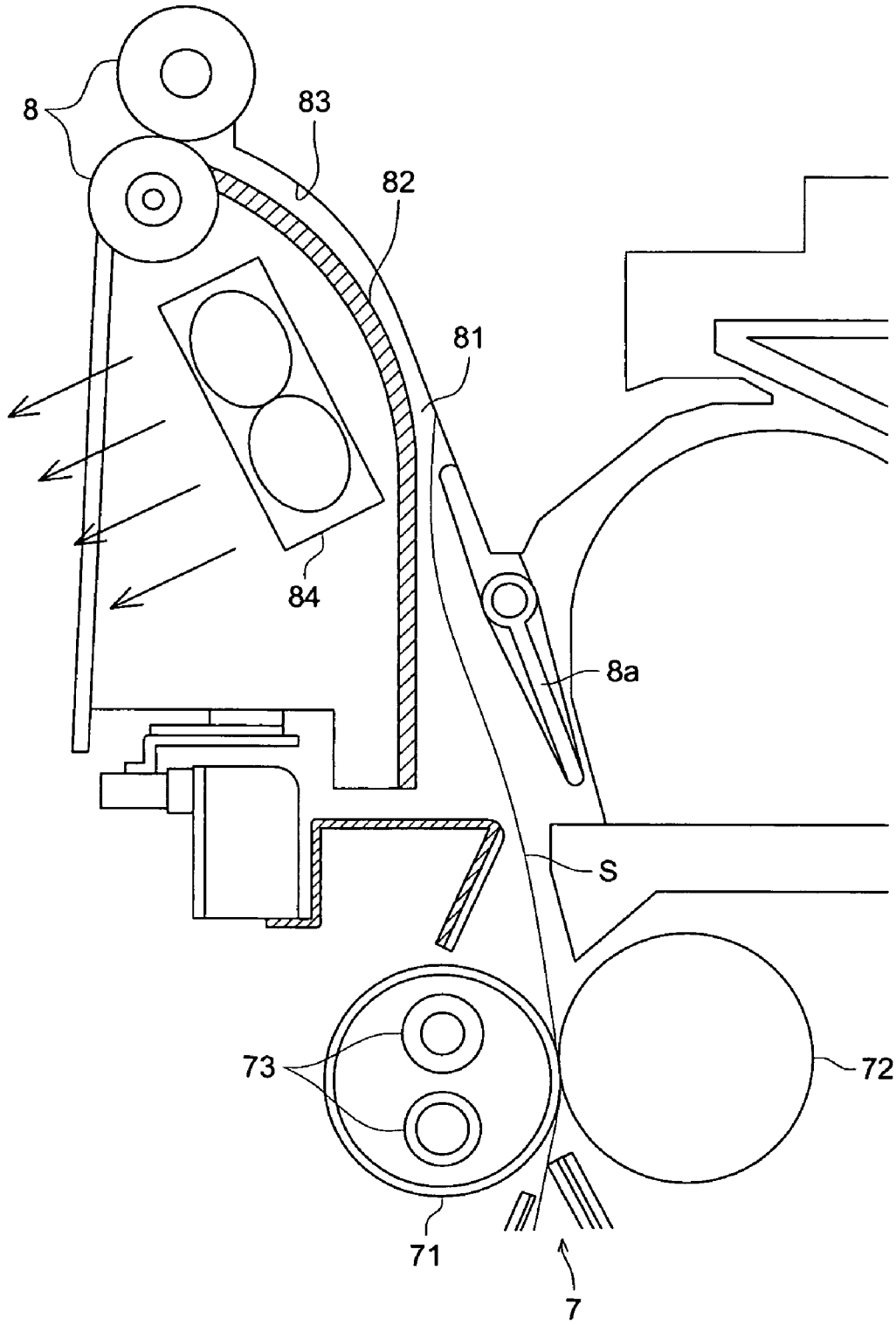
FIG. 3 shows the structure from the fixing device to the sheet ejecting rollers of the second embodiment of the present invention.

FIG. 3 shows the second embodiment of the present invention. The same number designation will be given to the parts in FIG. 3, which are the same as those of FIGS. 1 and 2. Conveyance route 81 is composed of guide plates 82 and 83. Guide plate 82 is formed of a material having higher heat radiation characteristics than that of guide plate 83. Cooling means 84 such as air suction can be provided on the back of guide plate 82, that is, the opposite side of conveyance route 81 with respect to guide plate 82. Guide plate 82 absorbs the heat from sheet S and radiates the heat to the environment. Cooling means 84 ejects air which is heated by the heat radiated from guide plate 82, to the outside of image forming apparatus 1 via an air vent, as shown by arrows in FIG. 3. Due to this, guide plate 82 can be cooled, and the heat of transfer sheet S can be effectively absorbed.

Additionally, in the above embodiment, a monochromatic image forming apparatus with an in-machine sheet ejection is used as image forming apparatus 1, however the present invention is not limited to said image forming apparatus 1.

What is claimed is:

1. An image forming apparatus, comprising:

an image forming section for forming a toner image on a transfer sheet;

a fixing section for fixing the toner image on the transfer sheet;

a sheet ejection section for ejecting the transfer sheet on which the toner image has been fixed; and a curved sheet guide section, including a first guide plate and a second guide plate, both of which are paired for sandwiching and guiding the transfer sheet from the fixing section to the sheet ejection section, the first guide plate being mounted on an inner curve of the curved sheet guide section, and the second guide plate being mounted on an outer curve of the curved sheet guide section;

wherein a heat radiation characteristic of the first guide plate is greater than a heat radiation characteristic of the second guide plate.

2. The image forming apparatus in claim 1, wherein the first guide plate and the second guide plate are formed of different materials.

3. The image forming apparatus in claim 1, wherein the first guide plate is formed of aluminum.

4. The image forming apparatus in claim 1, wherein the second guide plate is formed of resin.

5. The image forming apparatus in claim 1, further comprising a cooling section for cooling the first guide plate.

6. The image forming apparatus in claim 1, wherein the fixing section incorporates:

a heating member including a heater; and a pressure applying member, which nips the transfer sheet with the heating member;

wherein the first guide plate faces a surface of the transfer sheet which has been in contact with the heating member, and the second guide plate faces a surface of the transfer sheet which has been in contact with the pressure applying member.

7. The image forming apparatus in claim 1, wherein the first guide plate incorporates a plurality of ribs for radiating-heat.

* * * * *